US007397387B2

(12) United States Patent
Suzuki et al.

(10) Patent No.: US 7,397,387 B2
(45) Date of Patent: Jul. 8, 2008

(54) LIGHT SCULPTURE SYSTEM AND METHOD

(75) Inventors: Kent Suzuki, Oakland, CA (US); Vim Venture, Valparaiso, IN (US)

(73) Assignee: Mattel, Inc., El Segundo, CA (US)

( * ) Notice: Subject to any disclaimer, the term of this patent is extended or adjusted under 35 U.S.C. 154(b) by 140 days.

(21) Appl. No.: 11/180,968

(22) Filed: Jul. 13, 2005

(65) Prior Publication Data

US 2006/0017586 A1 Jan. 26, 2006

Related U.S. Application Data

(60) Provisional application No. 60/587,703, filed on Jul. 14, 2004.

(51) Int. Cl.
*G08B 5/00* (2006.01)

(52) U.S. Cl. ..... 340/815.4; 345/31

(58) Field of Classification Search ..... 340/815.4; 345/31, 56, 82, 419, 420, 424
See application file for complete search history.

(56) References Cited

U.S. PATENT DOCUMENTS

| | | | | | |
|---|---|---|---|---|---|
| 3,097,261 | A * | 7/1963 | Coddington et al. | ..... | 345/31 |
| 4,160,973 | A | 7/1979 | Berlin, Jr. | | |
| 4,298,868 | A * | 11/1981 | Spurgeon | ..... | 345/31 |
| 5,057,827 | A * | 10/1991 | Nobile et al. | ..... | 345/31 |
| 5,406,300 | A | 4/1995 | Tokimoto et al. | | |
| 5,717,416 | A * | 2/1998 | Chakrabarti | ..... | 345/31 |
| 5,745,197 | A * | 4/1998 | Leung et al. | ..... | 349/77 |
| 5,748,157 | A | 5/1998 | Eason | | |
| 6,037,876 | A | 3/2000 | Crouch | | |
| 6,115,006 | A * | 9/2000 | Brotz | ..... | 345/31 |
| 6,144,384 | A * | 11/2000 | Nakazawa | ..... | 345/424 |
| 6,265,984 | B1 | 7/2001 | Molinaroli | | |
| 6,278,419 | B1 * | 8/2001 | Malkin | ..... | 345/31 |
| 6,420,698 | B1 * | 7/2002 | Dimsdale | ..... | 250/234 |
| 6,487,020 | B1 * | 11/2002 | Favalora | ..... | 359/619 |
| 6,639,571 | B2 * | 10/2003 | Wang | ..... | 345/31 |
| 6,697,034 | B2 * | 2/2004 | Tashman | ..... | 345/31 |
| 6,753,847 | B2 * | 6/2004 | Kurtenbach et al. | ..... | 345/31 |
| 6,765,566 | B1 * | 7/2004 | Tsao | ..... | 345/419 |
| 6,856,303 | B2 * | 2/2005 | Kowalewski | ..... | 345/31 |
| 7,099,701 | B2 * | 8/2006 | Lo et al. | ..... | 345/82 |

* cited by examiner

*Primary Examiner*—John Tweel, Jr.
(74) *Attorney, Agent, or Firm*—Bell, Boyd & Lloyd, LLP

(57) ABSTRACT

A moving, pulsed-light-source light sculpture display with communication between a stationary portion, i.e. the knobs and buttons and their corresponding electronics, and rotating and illuminated PCBs. An optical data link is implemented with an IR LED in the stationary base unit and an IR receiver on the rotating PCB. A user interface allows the user to easily draw in the 3D volume of the display in real time. The portion of the user interface used to create sculptures in the 3D volume of voxels includes multiple physical elements including knobs, pushbuttons, and a multi-position slide switch. Another element of the user interface is a movable blinking cursor in the display volume that indicates the current voxel being manipulated. User interface controls also provide functions for data in memory for saving/recalling user sculptures and animation. Animations are facilitated in which 3D volumes of the volumetric display move in synchronization.

41 Claims, 9 Drawing Sheets

LIGHT SCULPTURE SYSTEM AND METHOD

CROSS-REFERENCE TO RELATED APPLICATION

This application claims priority pursuant to 35 USC 119(e) to U.S. Provisional Application No. 60/587,703 filed Jul. 14, 2004, which application is specifically incorporated by reference in its entirety.

BACKGROUND OF THE INVENTION

Illuminated lamps, mood lights and the like, for example the well known Lava™ lamp, for displaying kinetic movements have been known to provide interesting room decor. To this end, passive illuminated displays are known in the art. Two-dimensional planar and cylindrical surface displays using visual persistence have been incorporated into signage, clocks, message displays and the like that are not solid sculptures. However it would be desirable to facilitate the ability for users to perform light sculputure with an active and/or interactive illuminated display in multiple dimensions.

The present invention relates to Light Sculpture systems and methods, herein 3 dimensional light sculpture, referred to as 3DLS or 3D Light Sculpt. The disclosed Light Sculpture systems and methods provide an array of, e.g., 4 columns of LED's that take advantage of visual persistence phenomenon and allow kids to create, animate and save LED sculptures they make on the apparatus. The child controls which LED is ON/Off by knobs and buttons located on the front of the apparatus. To this end a no mess, creative play solution is provided that allows users to create, animate, and save their creations. Children may thus create in three-dimensions, personalize with phrases, pictures, designs. Additionally the use of interactive light sculputure may be used as creative room decor that cycles through images, sounds, animations etc.

The described embodiments teach kids how to think and create in three-dimensions, and allow them to Create, Animate and Save light sculptures they make. Additionally, software cartridges may be provided containing new pre-made sculptures and sound effects allowing kids to experience new images, sounds and give them a place to save all of their creations. The base apparatus contains built-in sculptures, animations and ability to create, animate and store new drawings. The apparatus also may provide an expansion port allowing for new sounds, sculptures and animations. It may also be desirable to provide high resolution renderings, and multicolor, Red/Green/Blue LED's to illuminate full color image sculptures. Features include: 3D Light sculpting that teaches kids to think, draw and create in 3D; customization of sculptures for storage in memory; entertainment by watching the display; and memory cartridges allowing for purchase of content.

SUMMARY OF THE INVENTION

The volumetric display is provided based on the widely known phenomenon of image persistence in the human eye. A moving, pulsed light source can be made to appear as a stationary point of light in space if repetitive movement is used which is faster than the eye can follow, and the timing of the light pulses is such that they always occur at the same point in space. The embodiments include communications between the stationary portion, i.e. the user interface knobs and buttons and their corresponding electronics, and the rotating PCB and an intuitive user interface that allows the user to easily draw in the 3D volume and interact with the display in real time. The user interface is used to create sculptures in the 3D volume of voxels. A rotating printed circuit board (PCB) and the plurality of vertical illuminating PCBs are attached. A multiplicity of light emitting elements is provided on each of the plurality of illuminating PCBs. Microcontrollers are used for sending data output to the multiplicity of light emitting elements of the volumetric three-dimensional display with user interface controls being used to create sculptures in the volume of voxels comprising multiple spatial elements.

BRIEF DESCRIPTION OF THE DRAWINGS

The novel features believed characteristic of the invention are set forth in the appended claims. The invention itself, however, as well as the preferred mode of use, further objectives and advantages thereof, is best understood by reference to the following detailed description of the embodiments in conjunction with the accompanying drawings, wherein:

DETAILED DESCRIPTION OF PREFERRED EMBODIMENTS

Figure 1:
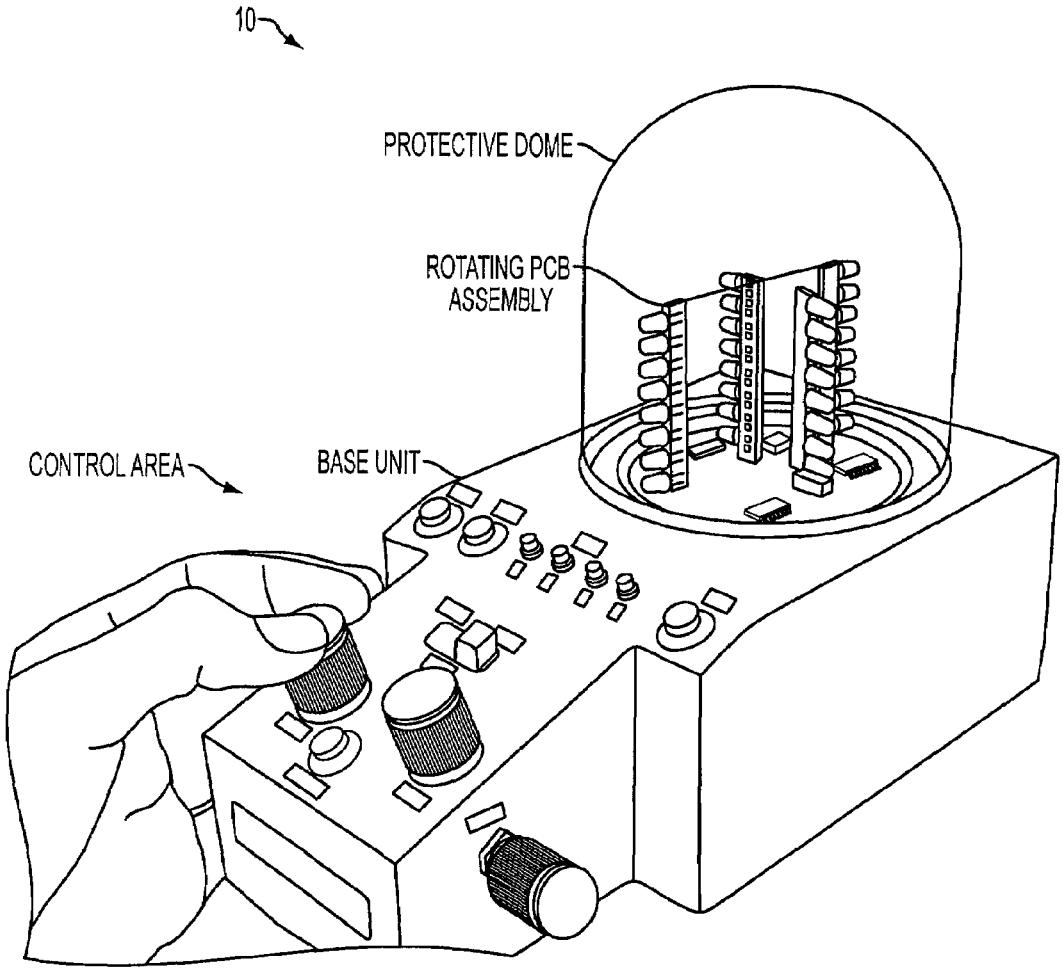
FIG. 1 is a perspective view of the three-dimensional light sculpture system in accordance with the present invention.
Figure 2:
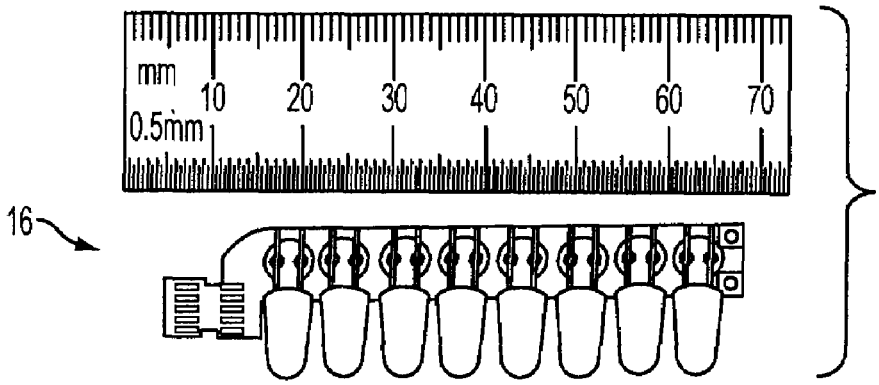
FIG. 2 shows the vertical PCB with LEDs attached.
Figure 3:
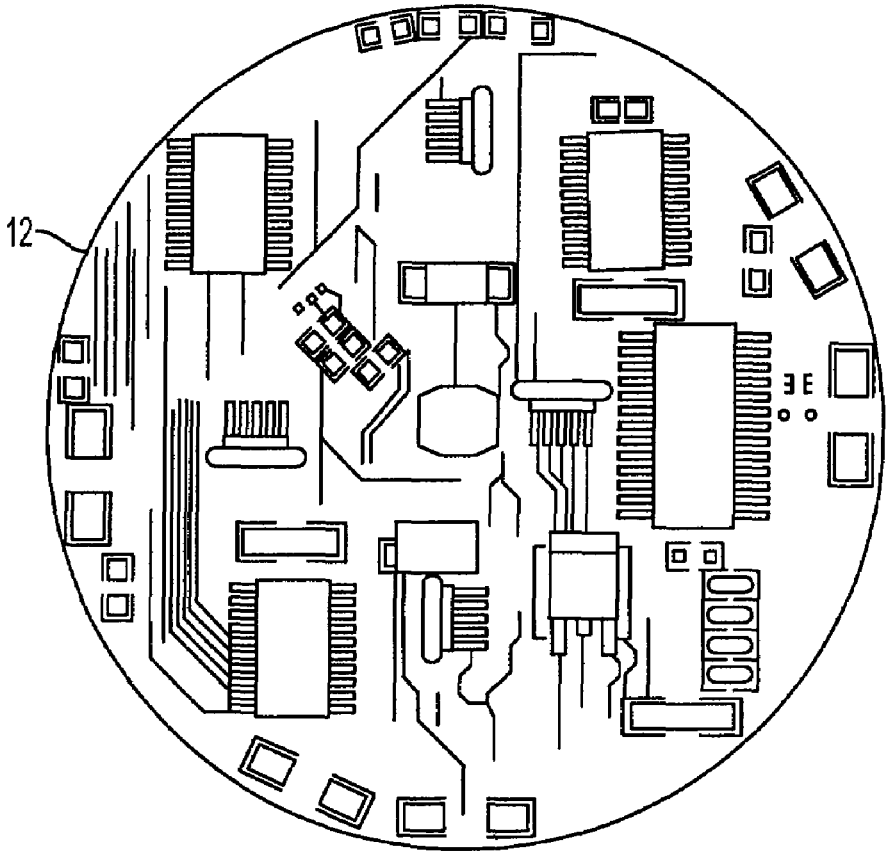
FIG. 3 shows the three-inch diameter rotating PCB showing slots for vertical PCBs.
Figure 4A:
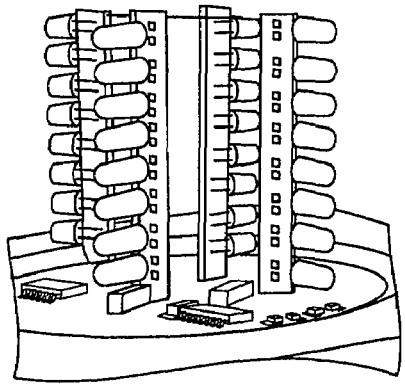
FIGS. 4A, B and C show three views of the entire rotating PCB assembly.
Figure 4B:
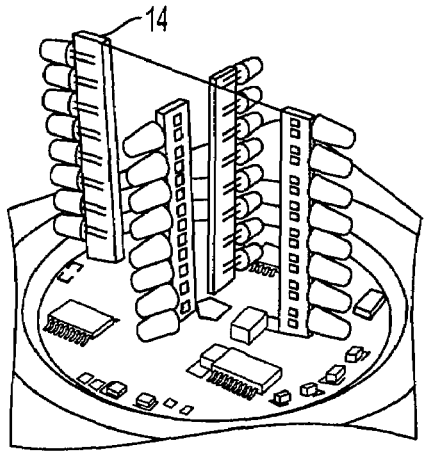
Figure 4C:
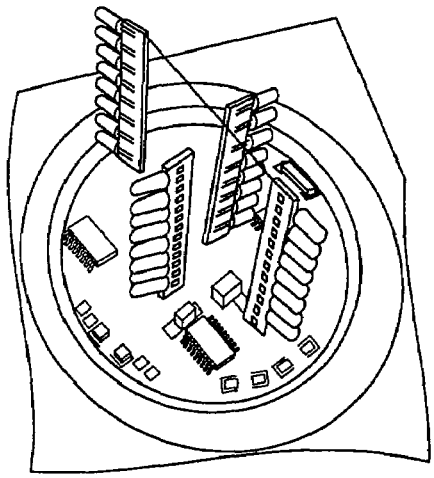

The volumetric 3D display 10 itself is based on the widely known phenomena of image persistence in the human eye. A moving, pulsed light source can be made to appear as a stationary point of light in space if repetitive movement is used which is faster than the eye can follow, and the timing of the light pulses is such that they always occur at the same point in space.

The display 10 includes a round, horizontal, three inch diameter, rotating printed circuit board 12 (PCB) with 4 vertical PCBs 14 attached. A method of attachment was used in which the vertical PCB 14 is keyed to fit into a slot on the horizontal PCB 12 which just fits into the thickness of the keying slot. The vertical PCB 14 is locked into a perpendicular orientation and no separate connector is required. Also, the vertical PCB 14 is oriented so the width of the PCB 14, not the thickness, points radially outward from the circle. Thus the full strength of the width of the vertical PCB 14, in this case 0.25 inches, rather than the thickness, typically 0.062 inches, resists the significant forces present when the board loaded with LEDs 16 is rapidly rotating.

The 4 vertical PCBs 14 each have eight standard 5 mm light emitting diodes 16 (LEDs) mounted horizontally. The vertical PCBs 14 are placed 90 degrees apart from each other, at the compass points, around the circle of the horizontal PCB 12. This is done for maximum visibility of all LEDs 16 as the PCB assembly rotates, as well as overall balance of the assembly. The LEDs 16 are oriented to face out from the center of the circle, and each vertical PCB 14 is a different distance from the center of the circle of the horizontal PCB 12.

The two innermost vertical PCBs are placed opposite each other, as are the two outermost. This configuration was chosen for the overall balance of the rotating assembly. Also, the two outermost vertical PCBs are joined at the top via a stiff wire truss. This is to prevent deflection from vertical due to the forces generated from the rotational motion.

Because of the staggered distance from the center of each of the vertical PCBs, as the whole assembly rotates, four concentric cylinders are traced out by the four vertical PCBs. That is, each vertical PCB has 8 LEDs and as it rotates each LED traces out a ring of light. There are then 8 rings of light stacked on top of each other to form a cylinder of light, assuming all LEDs are emitting light. Since there are four staggered vertical PCB subassemblies, there are four concentric cylinders of light.

The entire rotating assembly includes the horizontal PCB 12, the 4 vertical PCBs 14, all 32 LEDs 16, and other electrical components rotates quickly via an electric motor solidly mounted in the base of the product. The assembly rotates at roughly 50 revolutions per second. This is faster than the eye can follow, so the vertical PCBs and the unlit LEDs disappear from view as the whole assembly is rotating at speed.

On the horizontal rotating PCB 12 there are a number of electrical components, one of which is a microcontroller 18. For the prototype of the 3DLS, a Microchip 18F242 controller was used, operating at 20 MHz.

The display 10 is formed through a time based division of the rotating LEDs as they trace rings above the horizontal PCB. One of the functions of the rotating microcontroller 18 is to time the rotation of the PCB. There is a stationary infrared LED in the base of the 3DLS under the rotating PCB which is optically isolated from any areas other than directly above it. There is a corresponding infrared photodetector 20 on the rotating PCB that passes directly over this stationary LED once per revolution. The microcontroller 18 can measure the amount of time taken for one revolution of the PCB by monitoring the signal from the photodetector 20. Once this revolution time is known, the revolution of the PCB is broken into 64 equal time units. Each of these time units represents 1/64th of a complete revolution. In this manner the continuous and varying rotation of the PCB is divided into discrete segments. Each of these segments represents one volume-pixel, or voxel, for the rotating LEDs on the vertical PCBs. The rotating microcontroller 18 also uses the signal from the photodetector 20 to determine its absolute position relative to the infrared LED on the stationary PCB. This position is used as an index, or origin, to make sure the sculpture stays stationary while the user is making the sculpture.

As described above, there are 4 concentric light cylinders, one for each vertical PCB, and each cylinder includes 8 separate rings. These 8 rings are further divided into 64 equal segments. Thus there is a total of $4\times8\times64=2048$ voxels in the 3D display.

Each of the 2048 voxels is mapped to a single bit in the built-in RAM of the microcontroller, for a total of 256 8-bit bytes used. As the PCB assembly is rotating, the microcontroller tracks the time in terms of 1/64th of a revolution.

It should be noted that due to the higher linear speed of the LEDs near the outer edge of the volume as compared to the LEDs closer to the center, the outer voxels are larger than the inner. This was determined to have no effect on the aesthetics of the 3DLS prototype, but similar sized voxels can be implemented throughout the full volume of the display by dividing the outer rings into more segments than the inner rings.

For each of the four vertical PCBs there is a 74LVT574 chip, which is an octal D-flip-flop with high current capability. It serves the dual purpose of driving the LEDs at the proper current level as well as being an 8-bit memory. When the time is reached for the transition between adjacent voxels, the microcontroller reads the information stored in the internal RAM for the proper voxel to be displayed. A single byte of RAM represents the state of each LED in a single vertical column. So at each transition point, the microcontroller reads the data from the memory mapped image buffer in the internal RAM and stores it on the 74LVT574 chip. The 74LVT574 then drives each LED in the vertical stack according to the data supplied by the microcontroller. The controller places data on each of the four 74LVT574 chips sequentially, thus effecting the change from one voxel to the adjacent for each of the four columns of LEDs.

A three dimensional image can be loaded into the internal RAM locations on the microcontroller. As the PCB assembly rotates through a full circle, each memory location is accessed and displayed at the proper time, for the proper interval, so that the full three dimensional image appears.

Since the rotation of the PCB assembly is rapid, vision persistence in the human eye fills in the gaps between times where a voxel is actually being displayed, and a solid cylindrical volume of voxels appears.

An important aspect of the device is the communication between the stationary portion, i.e. the knobs and buttons and their corresponding electronics, and the rotating PCB. We have used an optical data link implemented with an IR LED in the stationary base unit and an IR receiver on the rotating PCB. The IR LED and IR receiver pair is similar to those commonly used for applications like TV remote controls. The field of view of the IR receiver used for the data link is such that it is never out of range of the stationary data LED as the receiver circles on the rotating PCB. Thus we have digital data communication between the stationary base unit and the rotating PCB. This infrared communication link is separate from the static IR LED and photodetector pair used to determine the position of the rotating PCB.

To supply reliable DC power to the rotating PCB we have used the well established method of motor brushes and slip rings. We use the shaft of the motor used to spin the PCB assembly as the negative electrical contact, so we only need one slip ring for the positive power supply. Small, stationary motor brushes contact the shaft and slip ring and transmit power to the rotating PCB.

In addition to the microcontroller on the rotating PCB, there is a second stationary microcontroller in the base unit. We have also used a Microchip 18F242 here, although there are many choices for controllers which may be better suited for a production version of the device. The stationary microcontroller has the duty of monitoring the various knobs and buttons of the user interface and transmitting any changes to the rotating PCB via the IR optical link. Additionally, this controller will interface to plug-in cartridges and access the data and functions stored on them, expanding the capability of the basic unit.

A simple and intuitive user interface allows the user to easily draw in the 3D volume of the display in real time. The portion of the user interface used to create sculptures in the 3D volume of voxels includes 6 physical elements: Three knobs, two pushbuttons, one 3-position slide switch. Another element of the user interface is a movable blinking cursor in the display volume that indicates the current voxel being manipulated.

First a description of the three knobs. These knobs are rotary encoders with no absolute start/stop position. The direction and distance of rotation is read from each knob by the stationary microcontroller. See FIG. 5 for the layout of the user interface.

The first knob, ROTATE, is used to spin the display volume about its central axis. Turning this knob clockwise will cause the display to rotate clockwise. A fast turn causes rapid rotation of the display, and a slower turn of the knob easily enables rotation of the display a single voxel at a time.

The next two knobs move the blinking cursor in the display volume. These knobs are IN/OUT and UP/DOWN. The UP/DOWN knob is physically oriented perpendicularly to the IN/OUT and ROTATE knobs.

Intuitively corresponding to the direction of motion of the cursor within the display volume, the IN/OUT and UP/DOWN knobs move the cursor in a plane that is 8 voxels high and 4 voxels deep directly in front of the user and perpendicular to the user. The cursor is confined to this plane. Combined with the ROTATE knob, the entire volume of the 3D display can be readily accessed. The user only works on the portion of the light sculpture that is directly in front of her. The sculpture is rotated around via the ROTATE knob to work on other portions.

The next element of the user interface for creation of images in the 3D display is the 3-position slide switch. The three positions are labeled DRAW, MOVE, and ERASE. This corresponds to three modes of drawing.

When the slide switch is in the DRAW mode, every move of the three knobs, ROTATE, IN/OUT, and UP/DOWN, results in the voxel that was just under the cursor to be set, or lit. For example, with a blank display volume (all voxels are off or unlit), while in DRAW mode spinning the ROTATE knob so the display rotates a full 360 degrees will result in a lit ring floating in the display volume. Likewise, turning the UP/DOWN knob will result in all voxels in a vertical stack to be lit. Turning the IN/OUT knob will draw a line at most 4 voxels deep pointing directly away from the user.

Conversely, the ERASE setting of the 3-position switch will cause every voxel encountered while manipulating the three movement knobs to be erased, or turned off. The MOVE or center position of the slide switch will leave each voxel that the cursor encounters unchanged as the user manipulates the three movement knobs. A lit voxel stays lit and a dark voxel stays dark in this mode.

The current mode of the device, DRAW, MOVE, or ERASE, is indicated not only by the physical position of the slide switch, but also by the blink rate of the cursor. This provides instant visual feedback to the user of the current mode of operation. The DRAW mode is indicated by a fast cursor blink rate of approximately 4 Hz. MOVE mode uses a medium blink rate of approximately 2 Hz, and ERASE mode is indicated by a slow blink rate of approximately 1 Hz.

The final user interface element used in the creation of images in the 3D display is the pushbutton labeled FLIP. The function of this button is independent of the mode of the device (DRAW, MOVE, or ERASE). The FLIP button will, naturally, flip the status of the voxel that the cursor is currently over. That is, if the voxel is on or lit, pushing the FLIP button will turn it off. Pushing the FLIP button on a voxel that is off will turn on that voxel. This allows the user to precisely and quickly toggle individual voxels, greatly easing and speeding the drawing process.

The layout of the three motion knobs, the 3-position slide switch, and the FLIP button has been carefully chosen for ease of use and intuitive feel.

There is one more pushbutton occasionally used in the drawing process, the CLEAR button. This pushbutton is physically located away from the other controls in the upper right portion of the control housing section of the base unit and is bright red as a caution cue. The location and color of this button were chosen to minimize the chances of an accidental push, since a press of this button will turn off all voxels in the 3D display, clearing any unsaved changes made by the user.

Multiple sculptures that are created by the user can be stored and readily recalled as user sculptures, pre-made sculptures, and animations for later display. The presently described embodiment of the 3DLS can store 4 user created sculptures. This is accomplished through four separate SAVE pushbuttons, illustrated in FIG. 5. The SAVE buttons are labeled A, B, C, and D. A simple push of one of these SAVE buttons will store the data from the 3D display into either internal EEPROM storage or into an external serial EEPROM, wherein the user interface controls SAVE functions provide for storing and recalling the data from the 3D display into either non-volatile memory. With separate individually accessible save locations, the user or multiple users can work on several sculptures at once.

Figure 5:
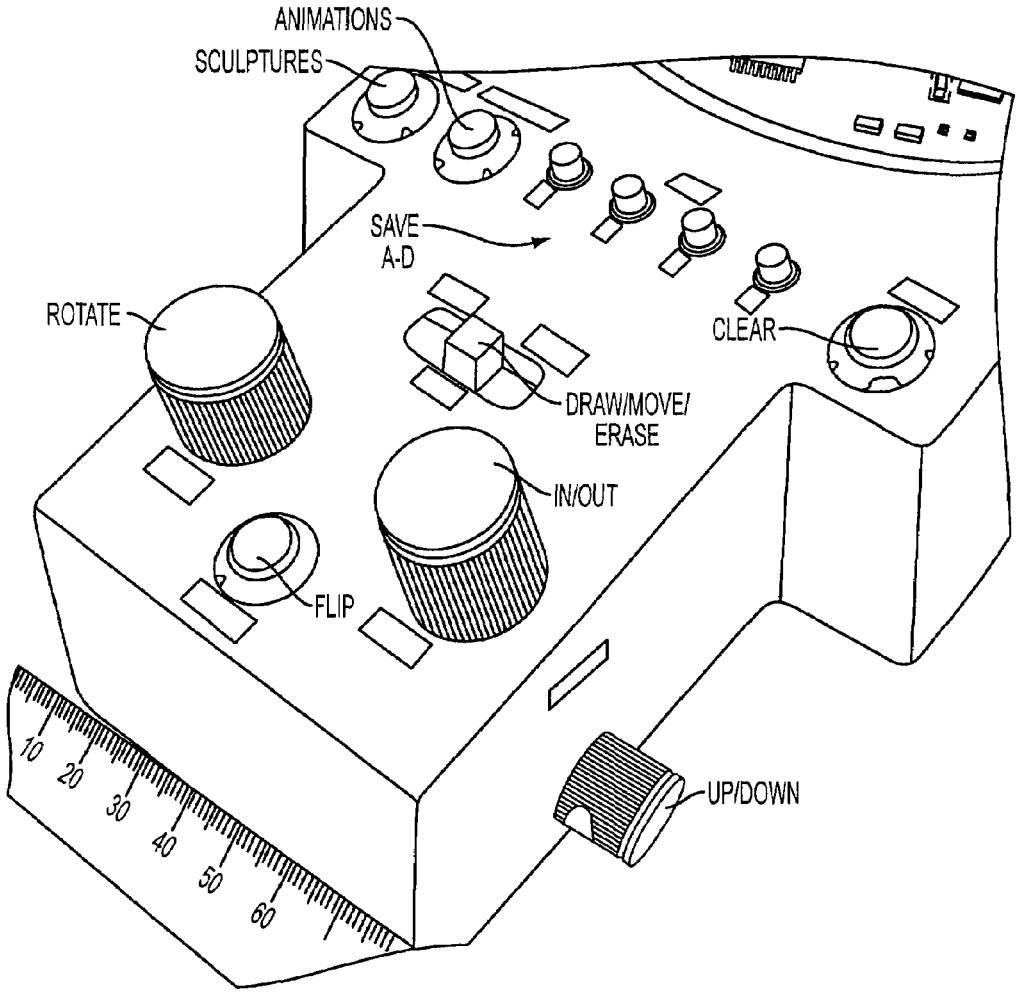
FIG. 5 shows the user interface including knobs, slide switch and push buttons.

The pushbutton on the upper left of the user interface area of the base unit is labeled SCULPTURES, see FIG. 5. Each push of this button will step through the display of a series of pre-made sculptures that are permanently programmed into the unit. Many sculptures can be programmed into the device to demonstrate the striking novelty, beauty, and potential of the three-dimensional display. This button also sequentially recalls the user saved sculptures which were saved using the SAVE A-D buttons. Once a permanently stored sculpture is displayed, it can be changed and customized through the drawing portions of the user interface previously described. Of course, a modified sculpture can be saved via one of the SAVE buttons. Through the SCULPTURES button, the user can recall his own creations or any of a series of preprogrammed sculptures for display and animation simply through multiple pushes of this single button.

An additional feature of the 3D display is the ability to animate displayed images. For instance, rather than just having the next stored sculpture instantly appear on the display when the SCULPTURES button is pushed, a visually stimulating animation provides a smooth transition between displayed sculptures. The prototype of the 3DLS uses a transition that evokes the concept of a sparkling energy filling in the entire volume of the display from bottom to top. This sparkling random energy persists briefly, then drains out the bottom of the display revealing the next sculpture. Another transition used in the 3DLS is descriptively labeled elevator-up. This transition causes the sculpture to be displayed to rise smoothly from the floor of the display. Transitions and animations in three dimensions provide a greatly enhanced and stimulating user experience. Additionally, through the various animations or sound reactivity, a function may be added, e.g., via the expansion port, to listen to ambient sounds and then react in three dimensions to the music, ambient sounds or the like.

There is a pushbutton labeled ANIMATE, see FIG. 5. Similar to the SCULPTURES button, there are a series of preprogrammed animations that this button steps through with each push. The animations developed for the prototype 3DLS are as follows:

1) rotating slowly clockwise
   The entire voxel volume rotates in sync at roughly 6.5 seconds for a full revolution
2) rotating faster counterclockwise
   The entire voxel volume rotates in sync at roughly 3.25 seconds for a full revolution
3) multi-go-round
   Each of the 4 concentric cylinders of voxels that make up the 3D display rotate in alternating directions. That is, the outermost cylinder rotates CW, the next rotates CCW, etc. . . .
4) liquify
   Visually reminiscent of food in a blender, this animation causes each of the 8 layers of the display to rotate in alternating directions. That is, all voxels on the top layer rotate CW, second from the top CCW, etc. . . .
5) round-n-down
   As the entire volume of voxels rotate in synch, the displayed sculpture sinks into the floor of the display. The portion of the image that sinks from view appears at the top of the display. Thus the animation continues smoothly and continuously.
6) pumping
   The image on the display alternately sinks into the floor, leaving the display blank, then rises smoothly up again to its original position.
7) peeling
   Each of the 4 cylinders that make up the display sink down into the floor of the device and then rise back up, but the 4 cylinders are out of step with each other. The timing is such that the cylinders appear to be peeled off one-by-one in a continuous wave.
8) slot machine up
   The image on the 3D display rises quickly up with all voxels in synch. The voxels that disappear from the top of the display appear at the floor of the display. Thus the image continuously rolls upwards.

Different types of sculptures look good with different animations. For instance, a complicated animal sculpture is effectively displayed using animation 1), while an abstract or geometric sculpture might be visually stimulating when viewed using animations 4) or 8). The ability to animate the pre made and user created sculptures adds a fascinating and often unexpected level of play to the invention.

The software is provided for the various aspects of the described embodiment. This section is further broken down into three subsections: a) Software to accept input from the user via the various knobs and buttons; b) Software to control the display itself; c) Software for animations.

Figure 6:
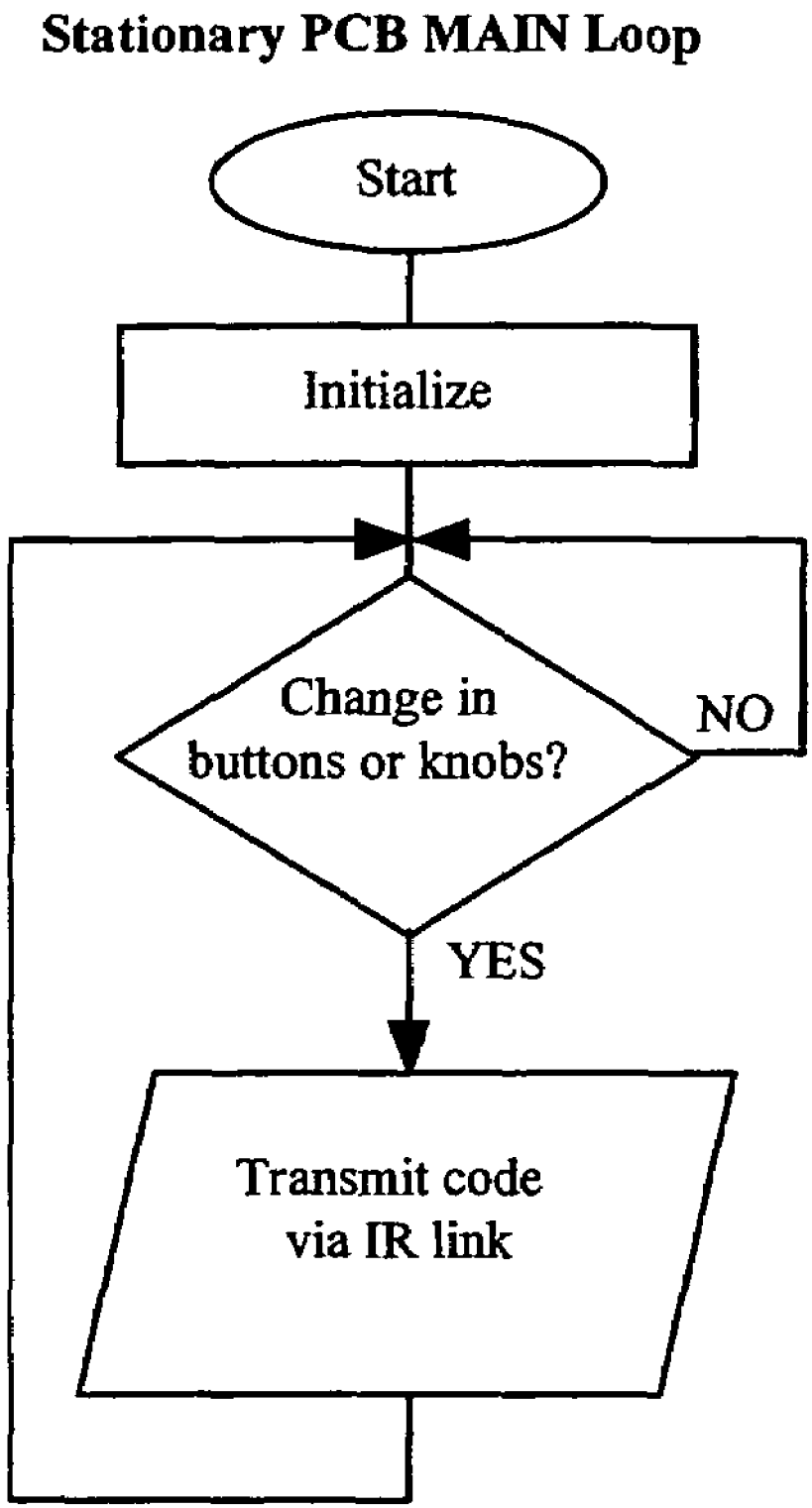
FIG. 6 is a program flow diagram showing the main software loop to poll the physical user interface.

The knobs and buttons that make up the physical user interface of the invention are scanned by the stationary 18F242 microcontroller in the base unit. A sequentially polled method of scanning is used. See FIG. 6, Stationary PCB MAIN Loop. Commands are sent to the rotating PCB via the IR optical link. A 38 KHz carrier frequency is superimposed, through software, on the data words sent via this link. This enables the IR receiver unit on the rotating PCB to recognize the signal sent from the base unit. The data words to be transmitted to the rotating PCB are "bit-banged" through an output port that drives an IR LED. A simple data protocol is used to separate commands generated from a turn of one of the rotary encoders from the other button pushes. The data protocol includes a unique first nibble (4 bits) being sent to identify rotary encoder commands. This data protocol is used to speed the command decode routine in the microcontroller on the rotating PCB.

Figure 7:
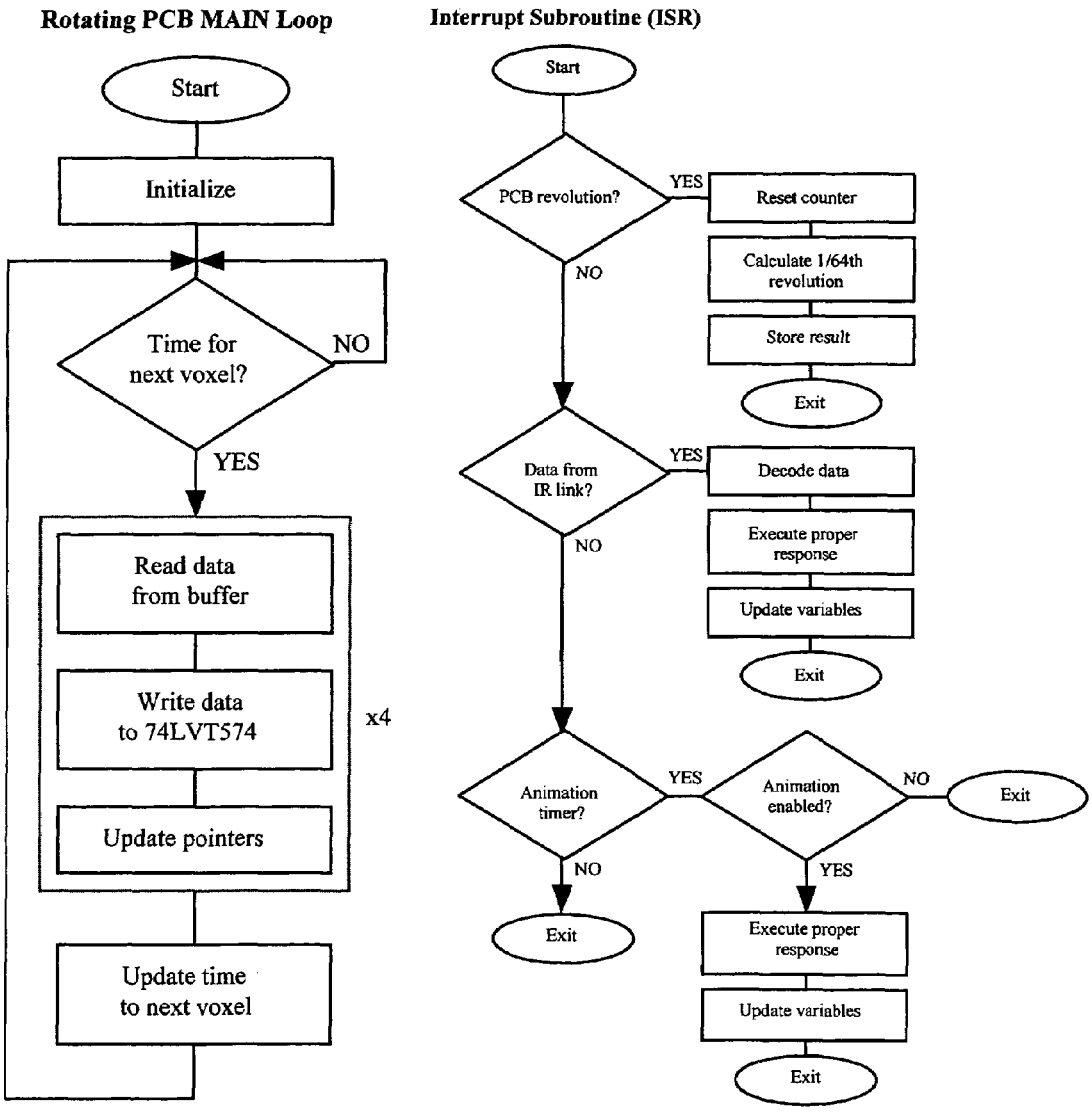
FIG. 7 is a flowchart identifying subroutines for the microcontroller to output data to the display including timing, animation and communication routines.
Figure 8:
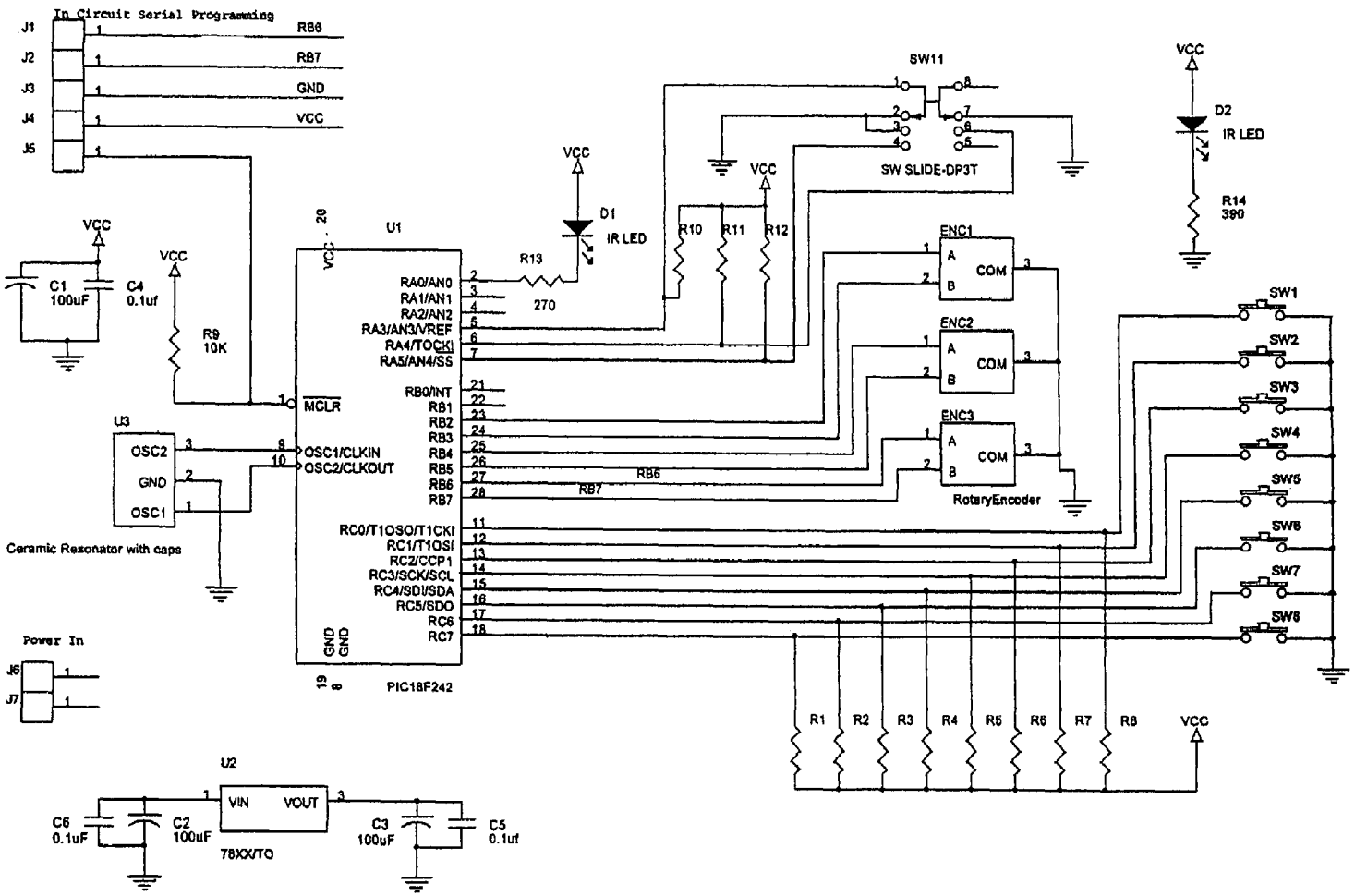
FIG. 8 shows a stationary printed circuit board schematic providing user interface controls to the apparatus.
Figure 9:
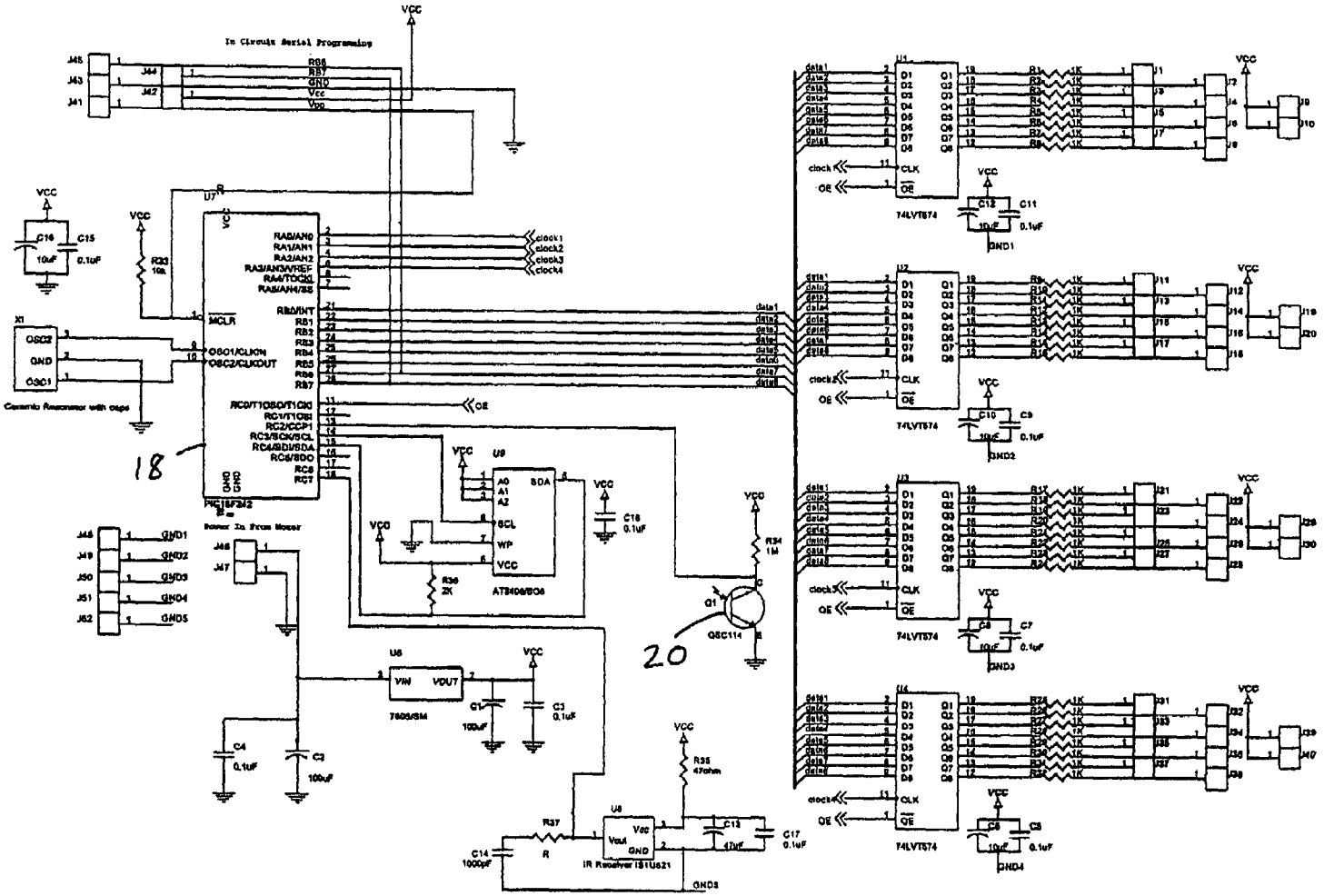
FIG. 9 shows a rotating printed circuit board schematic providing microcontroller control circuitry for displaying data to the volumetric display.
Figure 10:
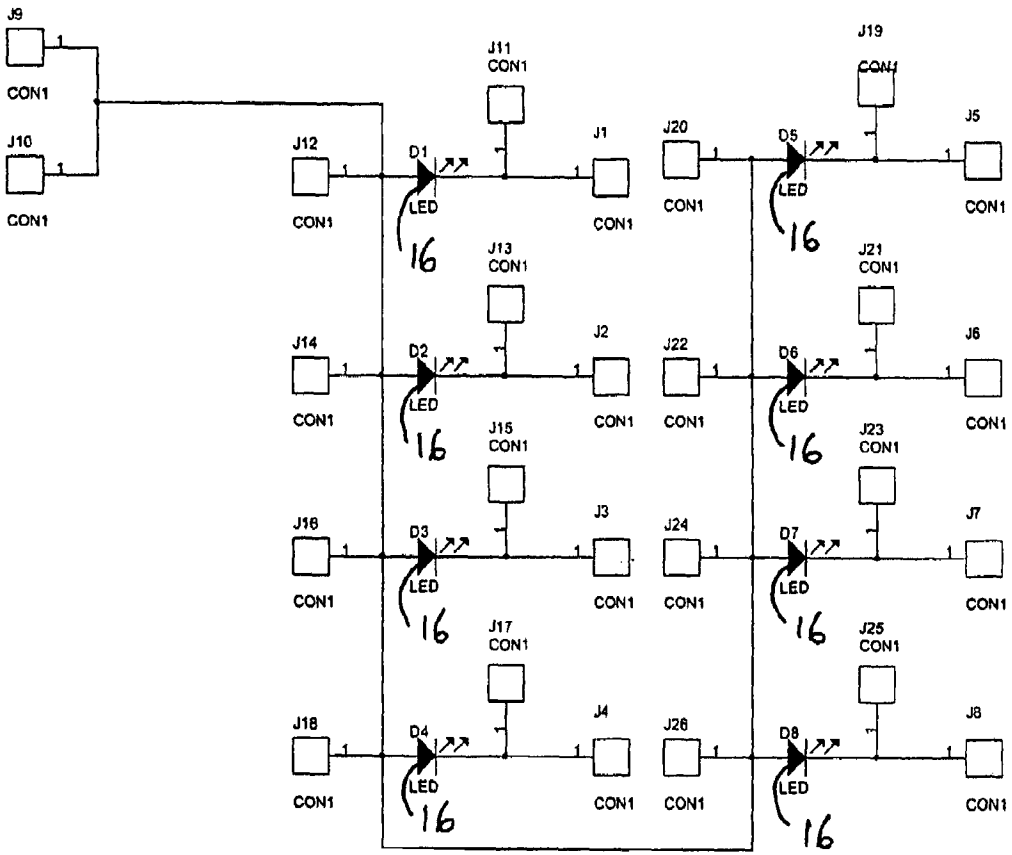
FIG. 10 shows a vertical illuminated printed circuit board schematic providing multiple LEDs used for displaying the voxel elements of the display.

The microcontroller 18 on the rotating PCB controls the output of data onto the display itself as well as various necessary timing, animation, and communication routines, see FIG. 7, MAIN and INTERRUPT routine flowcharts for rotating microcontroller 18. The software developed for the rotating microcontroller includes a main loop which is repeatedly run that displays data stored in the 256 byte RAM display buffer. This main routine is continuously executed. All the rest of the routines for this controller are interrupt driven and are executed as needed.

An interrupt driven counter/timer is used to determine the revolution time for the rotating PCB. Another counter is used to determine when a voxel transition has occurred (every 1/64th of a revolution). The main routine scans for a flag indicating that the voxel transition time has occurred, and then sends the proper data to the four 74LVT574 buffer/driver chips.

Animation software is also interrupt driven in the rotating PCB. As commands are received from the base unit, flag registers are set which direct the flow of the software code. When the animation mode is first initiated, a flag is set enabling the animation code to run. There is a timer running which periodically generates an interrupt, the animation interrupt. When the animation flag is set, the animation code is executed during this interrupt. The specific animation code to be executed is determined through a separate flag register. All animation code is skipped when the animation mode is disabled.

In addition to the primary 256 byte RAM display buffer that is used to store data to be displayed, there is a second 256 byte RAM buffer. This is used in several of the animation routines as storage. In addition, through a flag register, this secondary display buffer can become the primary display buffer. When enabled, the secondary buffer becomes the data source for the main display routine. This capability can be useful for some animations.

Future expansion of the invention is enabled via plug-in cartridges that house additional circuitry or electronic memory for functionality expansion through plug-in cartridges. Because of the expandable nature of the command data protocol used over the IR link, additional features are easily added to the invention. As cartridges are developed with added functionality, the stationary microcontroller is physically connected to the additional circuitry on the cartridge. As necessary, the stationary microcontroller need only send a new unique command word to the rotating PCB, and the rotating PCB controlling the display will respond appropriately.

An alternate method of expansion is possible through the use of a radio-frequency link between circuitry in the base unit and the rotating circuitry. As off-the-shelf RF link solutions become more cost effective, this method of communication between the stationary and rotating PCBs may become the method of choice. Higher data rates than the optical link can provide as well as two-way communication are significant advantages of this solution. Various means of communications may be employed using, e.g., serial links, physical contact, slip ring and brush etc. Error correction and coupling with AC bias may also faciliate operation in noisy transmission medium environments.

When the data rate can be made high enough for a given product price point, the sophisticated animation software can be removed from the rotating PCB where software upgrades are more difficult. The rotating PCB can then become just a display device and the evolving software can be housed in the more easily upgradeable base unit or plug-in cartridges.

Some examples of capability that can be added: A set of pre-made or "canned" three dimensional images can be stored on a cartridge for transmission to the 3D display. These could be original themed sets such as Farm Animals, Space, etc. . . . They could also be licensed characters such as Mickey Mouse™ or SpongeBob™.

Sounds associated with a light-sculpture, such as the moo of a cow in a Farm Animals cartridge, can also be added.

Sound reactivity can be added through a cartridge with a microphone and some additional circuitry. The invention can then react to ambient noises and change the 3 dimensional display as appropriate.

A computer interface or interface to other 3DLS units can be realized through cartridge expansion. The user could then share her creations with other owners of a 3DLS if the expansion functionality links similarly equipped 3DLS units. In the case of a computer interface, creations could be shared with anyone in the world through publishing sculpture data files on the internet. This could be achieved through private fan-based web sites or through a central site controlled by a business entity.

It should be appreciated that a wide range of changes and modifications may be made to the embodiments of the invention as described herein. Thus, it is intended that the foregoing detailed description be regarded as illustrative rather than limiting and that the following claims, including all equivalents, are intended to define the scope of the invention.

What is claimed is:

1. A light sculpture system comprising:

volumetric three-dimensional display assembly, comprising:

a rotating printed circuit board (PCB), a plurality of illuminating PCBs attached to the rotating PCB, and a multiplicity of light emitting elements on each of said plurality of illuminating PCBs;

a microcontroller for sending output of data to the multiplicity of light emitting elements of the volumetric three-dimensional display, said microcontroller controlling timing, animation, and communication routines;

and one or more user interface controls in communication with the microcontroller to allow a user to draw in a three-dimensional volume of the volumetric three-dimensional display in real time, wherein the microcontroller and one or more user interface controls are operable to control a first voxel and a second voxel, wherein the first voxel is controllable independently from any voxel adjacent to the first voxel and wherein the second voxel is controllable independently from any voxel adjacent to the second voxel.

2. A system as recited in claim 1, wherein the user interface controls are used to create sculptures in a 3D volume of voxels comprising multiple spatial elements.

3. A system as recited in claim 2, wherein the user interface controls comprise physical elements including knobs, push-buttons, and three-position slide switch.

4. A system as recited in claim 2, wherein the user interface controls comprise a knob and rotary encoder with direction and distance of rotation read by the microcontroller.

5. A system as recited in claim 2, wherein the user interface controls comprise a knob and rotary encoder with ROTATE used to spin the display volume about its central axis.

6. A system as recited in claim 2, wherein the user interface controls comprise IN/OUT and UP/DOWN knobs with a blinking cursor in the display volume.

7. A system as recited in claim 2, wherein the user interface controls comprise a ROTATE knob, wherein the entire volume of the 3D display can be readily accessed via the ROTATE knob to work on other portions.

8. A system as recited in claim 2, wherein the user interface controls comprise a multi-position switch with DRAW, MOVE, and ERASE corresponding to modes of drawing.

9. A system as recited in claim 2, wherein the user interface controls comprise a DRAW mode, wherein moves of ROTATE, IN/OUT, and UP/DOWN knobs results in the voxel that was just under the cursor to be set, or lit.

10. A system as recited in claim 2, wherein the user interface controls comprise an ERASE mode causing voxel encountered to be erased, or turned off.

11. A system as recited in claim 2, wherein the user interface controls comprise visual feedback to the user of the current mode of operation, DRAW mode being indicated by a fast cursor blink rate, MOVE mode being indicated by a medium blink rate, and ERASE mode being indicated by a slow blink rate.

12. A system as recited in claim 2, wherein the user interface controls comprise a FLIP function independent of the mode of the device (DRAW, MOVE, or ERASE) to flip the status of the voxel that the cursor is currently over, allowing the user to toggle individual voxels.

13. A system as recited in claim 2, wherein the user interface controls comprise SAVE functions for storing and recalling the data from the 3D display into non-volatile memory.

14. A system as recited in claim 13, comprising concentric light cylinders, one for each illuminating PCBs comprising separate rings divided into segmented voxels in the 3D display.

15. A system as recited in claim 1, wherein the user interface controls are used to create sculptures in a 3D volume of voxels comprising a movable blinking cursor in the display volume that indicates the current voxel being manipulated.

16. A system as recited in claim 1, wherein the rotating PCB is round and oriented horizontally with the illuminating PCBs being attached vertically to the rotating PCB.

17. A system as recited in claim 16, wherein the illuminating PCBs are keyed to fit into a slot on the horizontally rotating PCB, the vertical illuminating PCB being locked into a perpendicular orientation without separate connectors.

18. A system as recited in claim 1, wherein the multiplicity of light emitting elements comprise light emitting diodes (LEDs).

19. A system as recited in claim 1, wherein the volumetric three-dimensional display assembly comprises four vertical illuminating PCBs, multiple LEDs and electrical components for rotating quickly via an electric motor solidly mounted in a base.

20. A system as recited in claim 19, wherein the volumetric three-dimensional display assembly rotates at about 50 revolutions per second, such that the vertical illuminating PCBs and the unlit LEDs appear to disappear from the user's view while the assembly is rotating.

21. A system as recited in claim 1, comprising an expansion port operable with the microcontroller for additional functionality.

22. A system as recited in claim 1, comprising memory operable with the microcontroller for storing and recalling user sculptures, pre-made sculptures or animations for display from stored data.

23. A system as recited in claim 1, comprising memory operable with the microcontroller for animations wherein the three-dimensional volume of the volumetric three-dimensional display rotates in synchronization for a full revolution.

24. A system as recited in claim 1, comprising memory operable with the microcontroller for animations wherein the three-dimensional volume of the volumetric three-dimensional display animates concentric cylinders that rotate in alternating directions.

25. A system as recited in claim 1, comprising memory operable with the microcontroller for animations wherein the three-dimensional volume of the volumetric three-dimensional display animates concentric cylinders that liquify in fashion visually reminiscent of food in a blender wherein layers rotate in alternating directions.

26. A system as recited in claim 1, comprising memory operable with the microcontroller for animations wherein the three-dimensional volume of the volumetric three-dimensional display animates the displayed sculpture sinking from view.

27. A light sculpture method comprising:

providing a volumetric three-dimensional display assembly;

sending data to a multiplicity of light emitting elements of the volumetric three-dimensional display for controlling timing, animation, and communication;

establishing user interface controls to allow a user to draw in a three-dimensional volume of the volumetric three-dimensional display in real time; and determining a fixed plane of the volumetric three-dimensional display, wherein if a voxel is the focus of control, the voxel is in the fixed plane.

28. A method as recited in claim 27, wherein the user interface controls are used to create sculptures in a 3D volume of voxels comprising multiple spatial elements.

29. A method as recited in claim 27, wherein the volumetric three-dimensional display assembly comprises four vertical PCBs, multiple LEDs and electrical components for rotating quickly via an electric motor solidly mounted in a base.

30. A method as recited in claim 29, wherein the volumetric three-dimensional display assembly rotates at about 50 revolutions per second, such that the vertical illuminating PCBs and the unlit LEDs seem to disappear from the user's view while the assembly is rotating.

31. A method as recited in claim 27, comprising a random access memory (RAM) display buffer using a software main loop that repeatedly displays stored data.

32. A method as recited in claim 31, comprising the transmission of encoded data words to the rotating PCB using a data structure sent to identify the rotary encoder commands, wherein the data words are communicated through an output port.

33. A method as recited in claim 32, comprising the transmission of encoded data words to the rotating PCB using a serial link.

34. A method as recited in claim 32, comprising the transmission of encoded data words to the rotating PCB using a physical contact.

35. A method as recited in claim 32, comprising the transmission of encoded data words to the rotating PCB using a slip ring and brush.

36. A light sculpture system comprising:

means for providing a volumetric three-dimensional display assembly;

means for sending data to a multiplicity of light emitting elements of the volumetric three-dimensional display for controlling timing, animation, and communication;

means for establishing user interface controls to allow a user to draw in a three-dimensional volume of the volumetric three-dimensional display in real time;

means for controlling each of a plurality of voxels independently.

37. A system as recited in claim 36, wherein the means for establishing user interface controls are used to create sculptures in a 3D volume of voxels comprising multiple spatial elements.

38. A system as recited in claim 36, wherein the means for establishing user interface controls are used to create sculptures in a 3D volume of voxels comprising functions for data in memory for saying/recalling user sculptures and animation.

39. A system as recited in claim 36, wherein the means for establishing user interface controls are used to create sculptures in a 3D volume of voxels comprising functions for animations wherein 3D volumes of the volumetric display move in synchronization.

40. The method as recited in claim 27, further comprising:

rotating the voxels of the volumetric three-dimensional display about an axis of rotation to move a first voxel to the fixed plane; and causing the focus of control to be the first voxel.

41. The system as recited in claim 1, wherein the volumetric three-dimensional display assembly further comprises:

a base; and a non-opaque housing, the base and non-opaque housing enclosing the rotating printed circuit board, the rotating printed circuit board being configured to rotate relative to the non-opaque housing.

* * * * *